United States Patent [19]

Fukuda et al.

[11] 3,986,332

[45] Oct. 19, 1976

[54] THREAD-DRAW-OFF GUIDE ATTACHED TO A SPINNING ROTOR OF AN OPEN-END SPINNING UNIT

[75] Inventors: Tatemi Fukuda, Oobu; Yoshiaki Yoshida, Kariya, both of Japan

[73] Assignees: Kabushiki Kaisha Toyoda Jidoshokki Seisakusho; Dawa Boseki Kabushiki Kaisha, both of Osaka, Japan

[22] Filed: May 21, 1975

[21] Appl. No.: 579,677

[52] U.S. Cl. ..... 57/58.89; 57/77.4

[51] Int. Cl.[2] ..... D01H 1/12

[58] Field of Search ..... 57/58.89–58.95, 57/76, 77.4

[56] References Cited

UNITED STATES PATENTS

| | | | |
|---|---|---|---|
| 3,481,128 | 12/1969 | Landwehrkamp et al. | 57/58.89 |
| 3,640,061 | 2/1972 | Landwehrkamp | 57/58.89 |
| 3,778,989 | 12/1973 | Schon | 57/58.89 |
| 3,789,597 | 2/1974 | Schon | 57/58.89 |
| 3,805,505 | 4/1974 | Schuster | 57/58.89 |
| 3,834,147 | 9/1974 | Havranek et al. | 57/58.89 |
| 3,903,683 | 9/1975 | Shino | 57/58.89 X |

*Primary Examiner*—John Petrakes

*Attorney, Agent, or Firm*—Burgess Ryan and Wayne

[57] ABSTRACT

An improved thread-draw-off guide attached to a spinning rotor of an open-end spinning unit. The thread-draw-off guide is provided with a cylindrical annular guide portion and a radial outer surface extended outward from the cylindrical annular guide portion and the above-mentioned radial outer surface is formed with a roughened friction surface characterized in that the coefficient of friction thereof against a yarn in a radial direction is smaller than the coefficient of friction thereof against a yarn in a concentric direction thereof.

4 Claims, 6 Drawing Figures

THREAD-DRAW-OFF GUIDE ATTACHED TO A SPINNING ROTOR OF AN OPEN-END SPINNING UNIT

SUMMARY OF THE INVENTION

The present invention relates to an improved thread-draw-off guide attached to a spinning rotor of an open-end spinning unit.

From the conventional open-end spinning apparatus, such as the apparatus disclosed by the U.S. Pat. No. 3,640,061, it is well known that a thread-draw-off tube is centrally arranged in each spinning rotor for drawing off thread from the spinning rotor, and; that the opening of the draw-off tube is provided with a radial outer smooth surface extending into the path of the thread and an interior annular surface which is rough or notched.

The above-mentioned interior annular surface of the thread-draw-off tube creates a considerable degree of false twist when a thread is formed from a part of fibers accumulated on a ring shaped accumulation surface of the spinning rotor and the thread is drawn-off from the spinning rotor through the draw-off tube. According to our experience, if the frictional resistance of the above-mentioned interior annular surface is too strong, the surface of the thread delivered from the spinning rotor becomes roughened so that so-called neppy and fluffy thread is produced, even though a very effective false twist can be created so as to prevent any possible yarn breaks in the spinning rotor. Contrary to this, if the frictional resistance of the above-mentioned interior annular surface is very weak, since it is impossible to create an effective false twist, the strength of the thread in the spinning rotor becomes weak so that the thread is frequently broken during the drawing off operation of the thread from the spinning rotor. Consequently, it is very difficult to provide a pertinent thread draw-off guide attached to the spinning rotor for creating an effective false twisting operation.

The principal purpose of the present invention is to provide an improved thread draw-off guide attached to the spinning rotor of an open-end spinning unit which satisfactorily solves the above-mentioned problem.

To attain the purpose of the present invention, the thread draw-off guide according to the present is provided with a cylindrical annular guide portion formed in an axial portion thereof and a radial outer-surface extended from the cylindrical annular guide portion thereof toward the fiber accumulation surface of the spinning rotor. The radial outersurface is provided with a friction surface characterized in that the frictional resistance along the radial direction thereof is small while the frictional resistance toward concentric direction thereof is sufficiently strong to create effective rolling of the thread when the thread is drawn-off therethrough. The terms "radial direction" and "concentric direction" refer to the annular shape of the radial outer surface and the path along which the yarn travels on the outer surface. Thus the "radial direction" at any point on the outer surface is a direction parallel to the longitudinal path along which the yarn travels at that point on the outer surface, while the "concentric direction" at the aforementioned point on the outer surface refers to a direction tangential to the outer surface and at right angles to the longitudinal path along which the yarn travels at the aforementioned point on the outer surface. According to the above-mentioned characteristic feature of the friction surface formed on the radial outersurface of the thread drawoff guide, any possibility of the creation of neppy and fluffy thread and thread breakages can be satisfactorily eliminated.

DETAILED EXPLANATION OF THE PRESENT INVENTION

Figure 1:
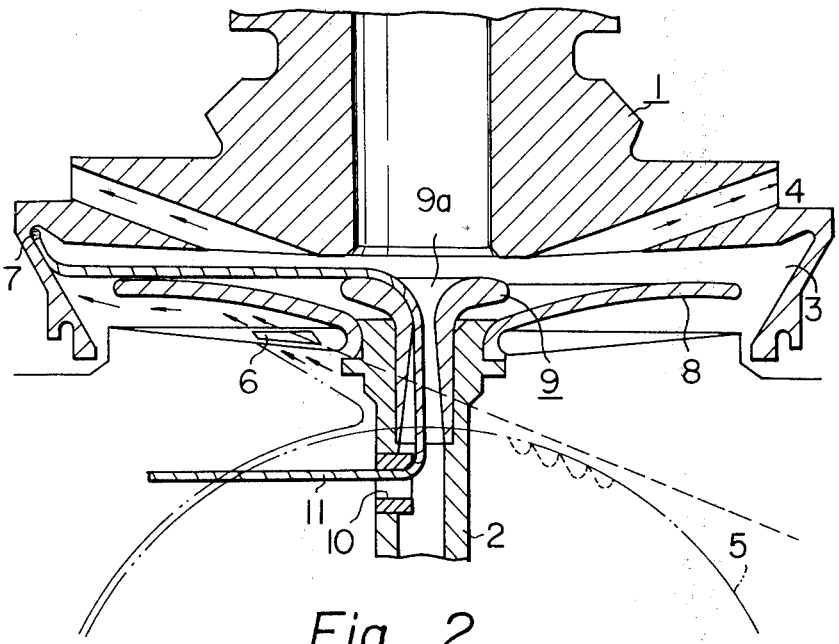
FIG. 1 is a schematic cross sectional view of a spinning rotor, taken along the axial direction thereof, according to the present invention.

Referring to FIG. 1, a spinning rotor 1 is driven at very high speed so that a spinning chamber 3 formed inside thereof is maintained in a suction condition and an air stream is formed from the chamber 3 toward outside of the spinning rotor 1 by way of a plurality of passages 4 formed in the body of the spinning rotor 1. Therefore, opened fibers separated from a combing roller 5 are carried into the chamber 3 of the spinning rotor 1 by an air stream passing through a connecting conduit 6 which tangentially extends from the combing roller 5 toward a ring shaped fiber accumulation surface 7 of the chamber 3. A funnel shaped stationary body 8 is coaxially disposed in the chamber 3 of the spinning rotor 1 in such a condition that a circular free end of the stationary body 8 extends toward the fiber accumulation surface 7 of the chamber 3 with an intervening space therebetween for permitting free fiber supply from the conduit 6 to the fiber accumulation surface 7 of the chamber 3. The funnel shaped stationary body 8 is rigidly held by a stationary annular tube 2 provided with an aperture 10. A trumpet type thread-draw-off guide 9 is coaxially held by the funnel shaped stationary member 8 in such a condition that an aperture of the guide 9 is connected to the aperture of the tube 2. During the operation, the fibers deposited on the fiber accumulation surface 7 of the chamber 3 are twisted into an end of a thread 11, which is drawn-off from the spinning chamber 3 of the spinning rotor 1, through the aperture 10. The above-mentioned twisting-in motion of fibers into the end of the thread 11 is created by the high speed rotation of the spinning rotor 1. However, if the radial outer surface of the thread-draw-off guide 9 does not have sufficient frictional resistance for creating rolling of the thread 11, that is, a false twisting effect upon the thread 11, the thread 11 is frequently broken because of an insufficient twisting in operation.

In a spinning rotor of the conventional open-end spinning apparatus, the thread-draw-off guide is provided with an interior annular surface which is rough or notched so as to create an effective twisting-in operation. However, it is very difficult to provide adequate frictional resistance to the roughened or notched interior annular surface of the thread-draw-off guide so as to create the above-mentioned effective twisting-in operation, as already explained.

To solve the above-mentioned problem, the thread-draw-off guide 9 of the spinning rotor 1 according to the present invention is provided with a radial expanded outersurface 9*a* connected to an interior annular surface 9*b*, (see FIG. 2) and the outersurface 9*a* is provided with a friction surface characterized in that the frictional resistance against the thread 11 in a radial direction of the outersurface is small, while the frictional resistance against the thread 11 toward concentric direction is sufficiently strong to effectively create the false twist upon the thread 11 when the thread 11 is drawing-off therethrough.

Such a particular friction surface of the outersurface 9*a* of the thread-draw-off guide 9 can be made by the following honing treatment of the guide 9. That is, after polishing the outersurface 9*a* of the thread-draw-off guide 9, the guide 9 is plated with hard-chrome and/or the hard-chrome plated guide 9 is polished, so that the roughened surface represented by HCLA 0.05 through 0.1 $\mu$ is created on the surface of the outersurface 9*a* of the guide 9; thereafter, the outersurface 9*a* of the guide 9 is finished by the conventional wet or dry honing treatment by utilizing a carborundum grinding stone of 50 through 200 mesh so as to create the friction surface of HCLA 0.5 through 18 $\mu$ on the outersurface 9*a* of the thread-draw-off guide 9. In the above-mentioned surface finishing of the thread guide 9, such a treatment as a blowing treatment by molten ceramic material upon the outersurface 9*a* can be effectively utilized instead of the hard-chrome plating.

Figure 2:
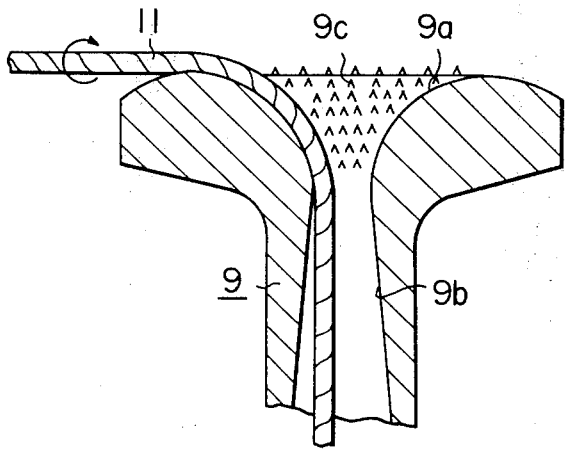
FIG. 2 is an enlarged schematic cross sectional view of a thread draw-off guide shown in FIG. 1.
Figure 3:
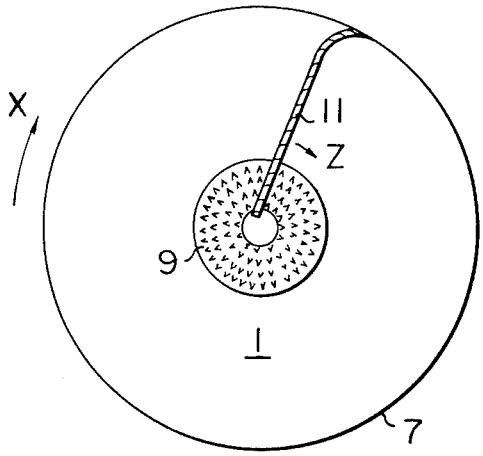
FIG. 3 is a schematic plan view of an inside portion of the spinning rotor shown in FIG. 1.
Figure 4:
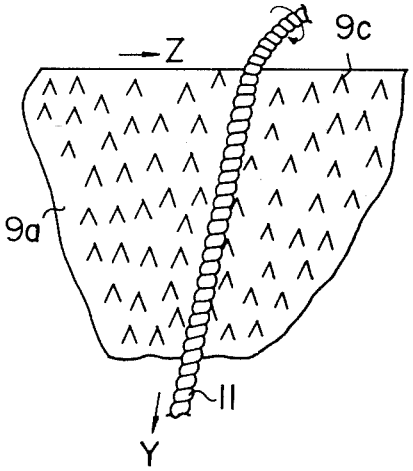
FIG. 4 is an enlarged perspective view of a part of a trumpet like opening portion of the thread draw-off guide shown in FIG. 2.

According to the above-mentioned surface finishing of the thread guide 9, numerous fine projection 9*c* are formed on the outersurface 9*a* of the thread guide 9 and each projection 9*c* is provided with a sharpened point. Consequently a roughened surface of the outersurface 9*a* is created as shown in FIGS. 2, 3 and 4. As a result, very effective false twisting is imported to the thread 11 when the thread 11 passes over the outersurface 9*a* of the thread-draw-off guide 9 according to the presented invention.

Figure 5:
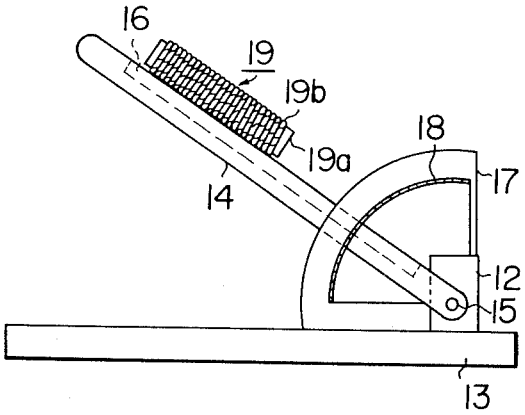
FIG. 5 is a side view of a measuring device for measuring a coefficient of friction between a roughened surface of a plate and a yarn.
Figure 6:
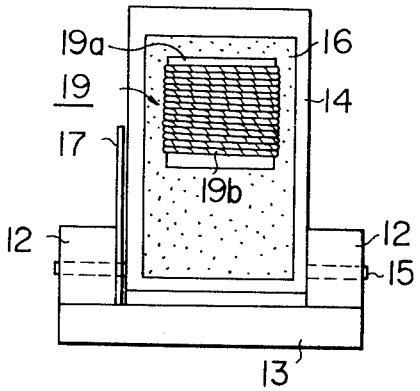
FIG. 6 is a front view of the measuring device shown in FIG. 6.

According to experimental measuring tests we conducted the coefficient of friction between the friction surface made by the above-mentioned honing treatment upon a metallic plate and a test piece of yarn, the coefficient of friction toward a lengthwise direction of the yarn is remarkably smaller than in the transversal direction. In these tests the measuring device shown in FIGS. 5 and 6 were used. That is, a pair of brackets 12 are secured to a horizontal base plate 13 and a flat plate 14 is turnably supported by the brackets 12 by way of a pair of horizontal pins 15 passing through the brackets 12. The flat plate 14 is provided with a rectangular recess which holds a metallic plate 16 provided with a friction surface in such a condition that the friction surface thereof forms a common plane with the surface of the flat plate 14 as shown in FIG. 5. A angle scale 17 is secured to one of the brackets 12 in such a condition that the turning angle of the upper common plane of the flat plate 14 and the metallic plate 16 can be measured by the scale 18 of the angle 17. A test piece 19 is made in such a way that a yarn 19*b* is wound about a piece of a flat plate 19*a* in parallel condition. Therefore, if the test piece 19 is deposited on the friction surface of the metallic plate 16 in such a way that the wound yarn 19*b* of the metallic plate 19*b* directs to a direction perpendicular to the axial direction of the pins 15, the coefficient of friction $\mu e$ between the friction surface of metallic plate 16 and the yarn toward lengthwise direction of the wound yarn 19*b* can be obtained by measuring the turning angle $\theta$, which is the turning angle when the test piece 19 commences to slide down, and applying it to the following equation $$\mu e = \tan \theta,$$

On the other hand, if the test piece 19 is deposited on the friction surface of the metallic plate 16 in such a way that the wound yarn 19*b* parallel with to the horizontal pins 15, the coefficient friction $\mu t$ between the friction surface of the metallic surface and the yarn toward the transversal direction to the yarn can be measured in the same manner as the above-mentioned measurement of $\mu e$.

The following data was obtained from tests utilizing the flat metallic plate provided with an identical honing treated friction surface to the honing treated friction surface of the above-mentioned thread-draw-off guide and a cotton yarn 20S, wherein the weight of the test piece 19 was 170 g. As is clearly shown, $\mu e$ is very low in comparison to $\mu t$.

In the above-mentioned test, the metallic plate 16 is provided with the friction surface.

In the above-mentioned test, two different metallic plates 16 provided with a millar finish and a statin finish, respectively, are used for comparison with the friction surface made by the honing treatment. The tests results are shown in the following table.

| Condition of the friction surface of the plate 16 | $\mu$e | $\mu$t |
|---|---|---|
| millar finish | 0.314 | 0.314 |
| statin finish | 0.259 | 0.268 |
| honing finish | 0.293 | 0.407 |

As it is clearly shown in this table, the coefficient of friction $\mu e$ of these three friction surfaces are not so different, while $\mu t$ of the friction surface made by the honing finish is remarkably larger than the other two friction surfaces. Consequently, very effective false twisting operation of the thread 11 can be expected by utilizing the above-mentioned thread draw-off guide 9. The reason of creating the above-mentioned effective false twisting operation, can be explained as follows; that is, since the thread 11 is turned about the interior annular surface 9*b* of the guide 9 toward the Z direction in FIGS. 3 and 4 when the spinning rotor 1 rotates toward the X direction in FIG. 3 at a very high rotation speed, while the thread 11 is carried from the fiber accumulation surface 7 toward the aperture 10 (FIG. 1) of the guide 9, the thread 11 has to pass over numerous projections 9*c* during the above-mentioned turning motion thereof, since $\mu t$ is very high in comparison with $\mu e$. When the thread 11 is forced to pass over a plurality of projections 9*c* along the concentric direction Z of the outersurface 9*a* of the thread guide 9, by the high speed turning motion of the spinning rotor 1, a rolling motion of the thread 11 about the longitudinal axis thereof is effectively created, however, the frictional resistance of the projections 9*c* to the thread 11 along the lengthwise direction thereof is very weak so that the tension is not so strong that the surface of the thread 11 is not damaged. According to our experimental tests to confirm the effect of the thread-draw-off guide of the present invention, it was confirmed that the spinning operation could be carried out without thread breakage, and that thread having a very fine quality could be produced. Therefore, the present invention can be applied to the conventional spinning rotor easily without changing the basic specification thereof. Further, since very effective false twists can be imparted to the thread 11 in the spinning rotor 1 by utilizing the thread draw-off guide according to the present invention, a thread having a low twist constant can be satisfactorily produced on a mass production scale.

What is claimed is:

1. In a spinning rotor of an open-end spinning unit provided with a thread draw-off guide coaxially arranged in said spinning rotor, said spinning rotor provided with a fiber accumulation surface formed therein, where in a thread is formed from fibers accumulated in said fiber accumulation surface of said spinning rotor and is drawn off from said thread draw-off guide, an improvement comprising said thread draw-off guide provided with a cylindrical annular guide portion formed in an axial portion of said thread guide and a radial outer surface extended from said cylindrical annular guide portion toward said fiber accumulation surface, said radial outer surface being a roughened friction surface characterized in that the friction surface comprises a smooth surface and a plurality of pointed members projecting from said smooth surface and in that the coefficient of friction thereof between said friction surface and said yarn at any given point on said friction surface in a radial direction of said outer surface is smaller than the coefficient of friction of said friction surface in a concentric direction of said outer surface at said given point, said radial direction at said given point being a direction along the longitudinal path of said yarn at said given point, and said concentric direction being a direction tangential to said friction surface at said given point and at right angles to said radial direction at said given point.

2. An improved thread draw-off guide of a spinning rotor according to claim 1, wherein said radial outer surface of said thread guide is a honed roughened surface.

3. An improved thread-draw-off guide of a spinning rotor according to claim 2, wherein said radial outer surface of said thread guide is a roughened surface of HCLA 0.5 through 18 $\mu$.

4. An improved thread draw-off guide of a spinning rotor according to claim 2, wherein said honed roughened surface is a chrome plated honed roughened surface.

* * * * *

UNITED STATES PATENT OFFICE

CERTIFICATE OF CORRECTION

Patent No. 3,986,332 Dated October 19, 1976

Inventor(s) Tatemi Fukuda, et al

It is certified that error appears in the above-identified patent and that said Letters Patent are hereby corrected as shown below:

On the title page, under "Assignees": "Dawa" should be --Daiwa--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*